US012540535B2

(12) United States Patent
O'Grady et al.

(10) Patent No.: US 12,540,535 B2
(45) Date of Patent: Feb. 3, 2026

(54) SYSTEM AND METHOD FOR CONNECTING LOAD BEARING ESP POWER CABLE

(71) Applicant: Baker Hughes Oilfield Operations LLC, Houston, TX (US)

(72) Inventors: Kenny O'Grady, Owasso, OK (US); Jason Hoines, Houston, TX (US); Austin Cookson, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/665,384

(22) Filed: May 15, 2024

(65) Prior Publication Data

US 2024/0384633 A1 Nov. 21, 2024

Related U.S. Application Data

(60) Provisional application No. 63/466,717, filed on May 15, 2023.

(51) Int. Cl.
*E21B 43/12* (2006.01)
*E21B 17/02* (2006.01)

(52) U.S. Cl.
CPC ..... *E21B 43/128* (2013.01); *E21B 17/023* (2013.01)

(58) Field of Classification Search
CPC ..... E21B 23/14; E21B 43/128; E21B 17/023; H01B 7/046
See application file for complete search history.

(56) References Cited

U.S. PATENT DOCUMENTS

| | | | | |
|---|---|---|---|---|
| 3,773,109 | A * | 11/1973 | Eberline | E21B 17/023 166/54.5 |
| 4,692,563 | A | 9/1987 | Lackinger | |
| 5,906,242 | A * | 5/1999 | Bruewer | E21B 17/003 166/378 |
| 2008/0236861 | A1 | 10/2008 | Bartholoma et al. | |
| 2009/0272575 | A1 | 11/2009 | Bae | |
| 2017/0117692 | A1 | 4/2017 | Swan | |
| 2019/0203855 | A1 | 7/2019 | White | |
| 2022/0301740 | A1* | 9/2022 | Matlack | H01B 7/046 |
| 2023/0110086 | A1 | 4/2023 | Yemawar | |

OTHER PUBLICATIONS

International Search Report and Written Opinion for PCT/US2024/029515 mailed Oct. 30, 2024.

* cited by examiner

*Primary Examiner* — Cathleen R Hutchins
(74) *Attorney, Agent, or Firm* — Baker Hughes Company

(57) ABSTRACT

A pumping system is configured to be deployed in a well on a continuous length of armored cable. The armored cable includes an outer layer of structural wire, an inner layer of structural wire, and a power cable inside the inner layer of structural wire. The cable adapter is connected between the pumping system and the armored cable to transfer the weight of the pumping system to the armored cable. The armored cable is connected to the pumping system with a cable adapter that includes a compression cap, a collet cap, an upper collet, and a lower collet.

17 Claims, 14 Drawing Sheets

SYSTEM AND METHOD FOR CONNECTING LOAD BEARING ESP POWER CABLE

RELATED APPLICATIONS

This application claims the benefit of U.S. Provisional Patent Application Ser. No. 63/466,717 filed May 15, 2023 and entitled, "System and Method for Connecting Load Bearing ESP Power Cable," the disclosure of which is herein incorporated by reference.

FIELD OF THE INVENTION

This invention relates generally to the production of hydrocarbons from a subterranean formation using an electric submersible pumping system, and more particularly, but not by way of limitation, to systems and methods for deploying an electric submersible pumping system within the wellbore.

BACKGROUND OF THE INVENTION

Submersible pumping systems are often deployed into wells to recover petroleum fluids from subterranean reservoirs. Typically, the submersible pumping system includes a number of components, including one or more electric motors coupled to one or more pumps. Each of the components and sub-components in a submersible pumping system is engineered to withstand the inhospitable downhole environment, which includes wide ranges of temperature, pressure and corrosive well fluids.

Conventional electric submersible pumping systems are connected to surface facilities and equipment through interconnected joints of rigid production tubing. The pumping system and tubing are often run inside a cased wellbore and the production fluids are pumped to the surface through the production tubing. The deployment and extraction of the pumping system are complicated, costly and time intensive endeavors because the downhole assembly is typically secured to a lower joint of the production tubing, which requires the operator to assemble or disassemble the joints above the electric submersible pumping system with a large workover rig. Workover rigs are often expensive and difficult to source.

As an alternative to the use of rigid production tubing, pump manufacturers have designed systems in which an electric submersible pumping system is installed within the wellbore using coiled tubing systems. One such example is the TransCoil brand rigless-deployed coiled tubing system developed by Baker Hughes Company. In these systems, the coiled tubing can be used to provide electrical power and support the weight of the electric submersible pumping system. The electric submersible pumping system can be configured to pump fluids to the surface through the annular space between the coiled tubing and the surrounding casing. In some cases, the use of a coiled tubing deployment system can reduce the installation time of the electric submersible pumping system by more than 50%.

Although these systems have achieved some commercial success, there remains a need for improved systems and methods for deploying an electric submersible pumping system using coiled tubing. In particular, a need exists for a system for quickly and securely connecting the pumping system to the coiled tubing that securely transfers the weight of the pump, motor and other downhole equipment to the armored cable. It is to this and other deficiencies in the prior art that embodiments of the present disclosure are directed.

SUMMARY OF THE INVENTION

In some embodiments, the present disclosure is directed to a pumping system configured to be deployed in a well, where the pumping system includes an armored cable, an electric motor, and a cable adapter. The armored cable includes an outer layer of structural wire, an inner layer of structural wire, and a power cable inside the inner layer of structural wire. The cable adapter is connected between the electric motor and the armored cable to transfer the weight of the electric motor to the armored cable. In some embodiments, the cable adapter includes a compression cap, a collet cap, an upper collet; and a lower collet. The lower collet can be secured directly or indirectly to the electric motor.

In other embodiments, the present disclosure is directed to a method for deploying a pumping system into a well, where the pumping system includes a pump connected to an electric motor. The method begins with the step of providing a length of armored cable that has an outer layer of structural wire, an inner layer of structural wire, and a power cable inside the inner layer of structural wire. The method also includes the step of providing a cable adapter that has a collet cap, a lower collet, an upper collet between the collet cap and the lower collet, and a compression cap. The method continues with the steps of extending the armored cable through the compression cap, routing the power cable to the electric motor through the lower collet, securing the outer layer of structural wire between the collet cap and the upper collet, securing the inner layer of structural wire between the upper collet and the lower collet, connecting the compression cap to the lower collet to apply a compressive force between the lower collet and the collet cap to capture the outer layer of structural wire and inner layer of structural wire within the cable adapter, and lowering the pump and motor into the well while transferring the weight of the pump and motor to the armored cable through the cable adapter.

In yet other embodiments, the present disclosure is directed at a method for connecting a cable adapter to an armored cable that includes an outer layer of structural wire, an inner layer of structural wire and a power cable inside the inner layer of structural wire. The method includes the steps of placing the outer layer of structural wire between an upper collet and a collet cap, placing the inner layer of structure wire between a lower collet and the upper collet, compressing the collet cap, the upper collet and the lower collet with an assembly tool, securing the upper collet to the collet cap with a first plurality of retaining pins, securing the lower collet to the upper collet with a second plurality of retaining pins, releasing the compression applied by the assembly tool to the collet cap, the upper collet and the lower collet, and installing a compression cap onto the lower collet and the collet cap to apply a compressive force between the lower collet, the upper collet and the collet cap.

DETAILED DESCRIPTION

Figure 1:
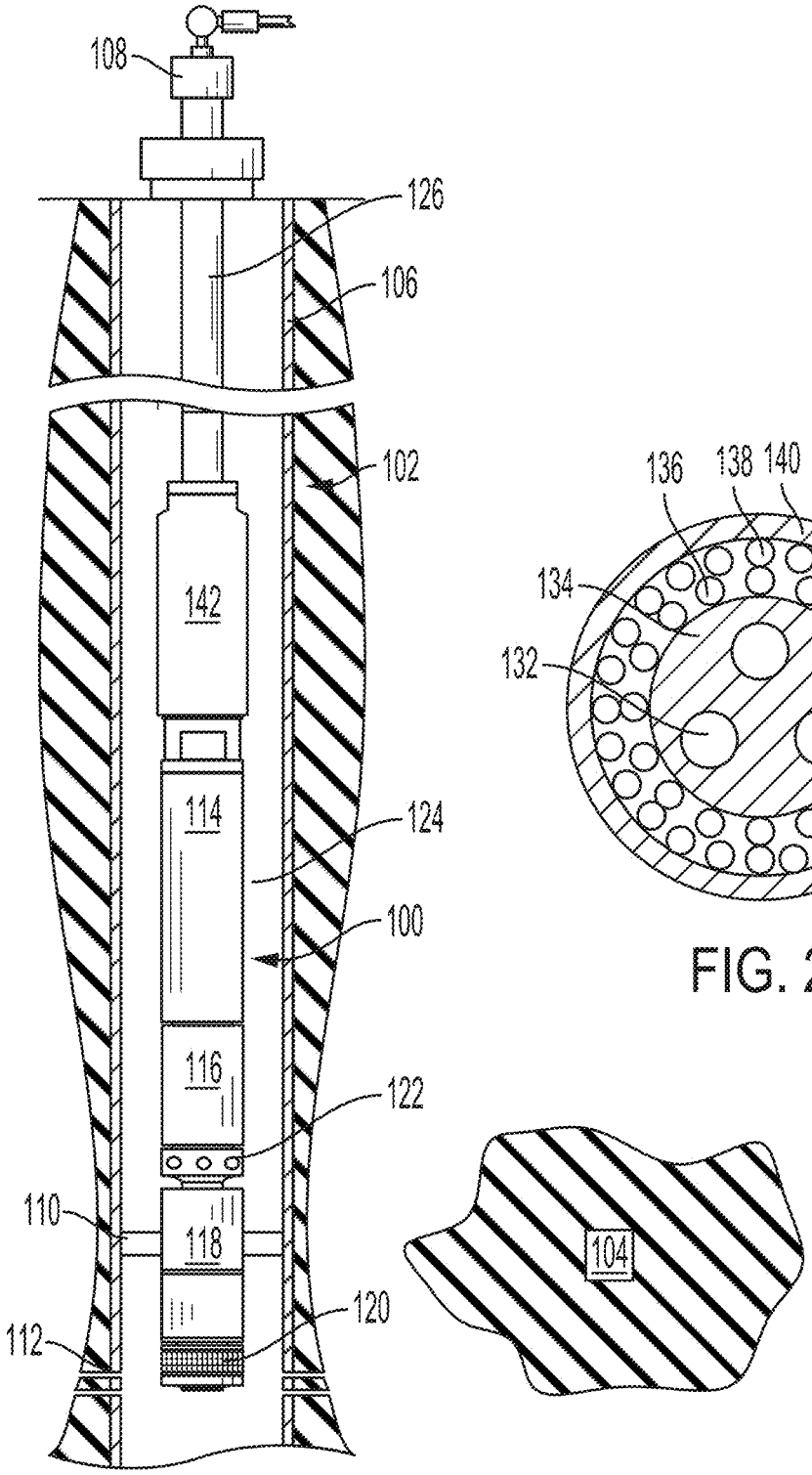
FIG. 1 depicts a pumping system constructed and installed in accordance with exemplary embodiments.

In accordance with exemplary embodiments of the present invention, FIG. 1 shows an elevational view of a first embodiment of a pumping system 100 installed in a well 102 within a reservoir 104. The well 102 includes a casing 106, a wellhead 108 and a lower completion 110. The pumping system 100 is connected to the lower completion 110, which may include a packer that forces reservoir fluids entering the well 102 through perforations 112 into the pumping system 100.

In the embodiment depicted in FIG. 1, the pumping system 100 includes a motor 114, a seal section 116 and a pump 118. The pumping system 100 is configured in an "inverted" orientation in which the pump 118 is positioned below the motor 114. The pump 118 includes a lower intake 120 and an upper discharge 122 that is configured to produce fluids through an annular space 124 between the pumping system 100 and the casing 106, where the fluids can be recovered through the wellhead 108. Although the pumping system 100 is well-suited for pumping petroleum fluids from the reservoir 104, it will be appreciated that the cable-supported pumping system 100 can also be configured to produce fresh water, brine, or other fluids from the reservoir 104. Additionally, it will be appreciated that the reservoir 104 and well 102 can be located onshore or offshore.

Figure 2:
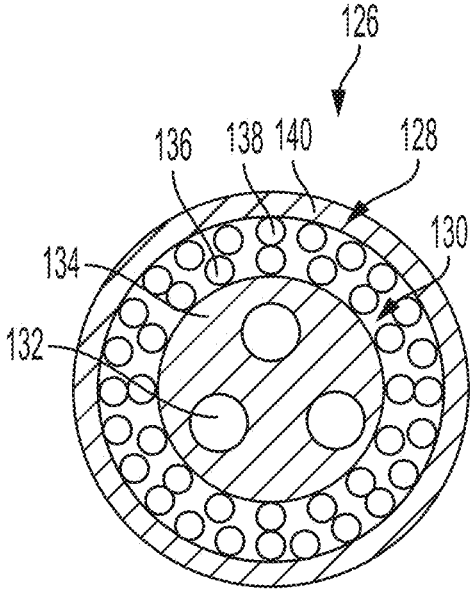
FIG. 2 is a cross-sectional view of the armored power cable used to suspend the motor and pump of the pumping system of FIG. 1.

The pumping system 100 includes a length of armored cable 126, which can be a continuous length of coiled tubing. The armored cable 126 includes an outer structural casing 128 and an interior power cable 130. A cross-sectional depiction of the armored cable 126 is depicted in FIG. 2. The interior power cable 130 includes one or more conductors 132 and one or more insulation layers 134 surrounding the conductors 132. In the embodiment depicted in FIG. 2, the structural casing 128 includes an inner layer of structural wire 136 and an outer layer of structural wire 138, which are both surrounded by an exterior sheath 140. The exterior sheath 140 can be constructed from one or more polymers that protect the inner layer of structural wire 136 and outer layer of structural wire 138 from abrasion or contact with wellbore fluids.

The inner and outer layers of structural wire 136, 138 each include a plurality of separable strands of wire that are wound or braided together. When the exterior sheath 140 is removed, the free ends of the inner and outer layers of structural 136, 138 can be separated by bending the individual wires of the outer layer of structural wire 138 away from the inner layer of structural wire 136, and the individual wires of the inner layer of structural wire 136 away from the interior power cable 130. As used herein, the term "layer" refers to the collection of wires or strands in either the inner or outer layers of structural wire 136, 138.

The pumping system 100 also includes a cable adapter 142 that is configured to connect the armored cable 126 to the motor 114 or other component within the pumping system 100. As explained herein, the cable adapter 142 provides a secure connection between the pumping system 100 and the structural casing 128 of the armored cable 126 that can be easily assembled in the field prior to deploying the pumping system 100 and armored cable 126 into the well 102. During deployment, the weight of the pumping system 100 is transferred to the inner and outer layers of structural wire 136, 138 of the structural casing 128 of the armored cable 126 through the cable adapter 142.

Figure 3A:
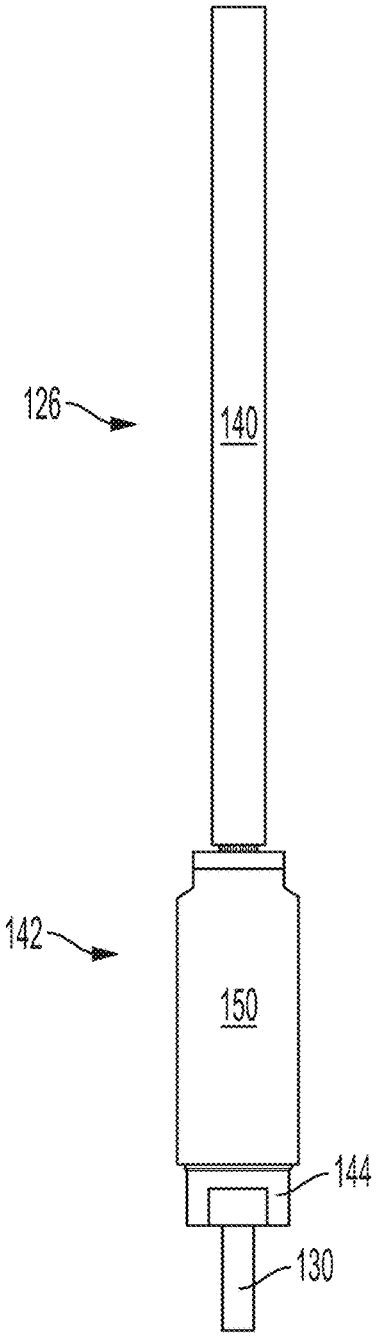
FIGS. 3A and 3B present side and exploded views of the power cable adapter and armored power cable.
Figure 3B:
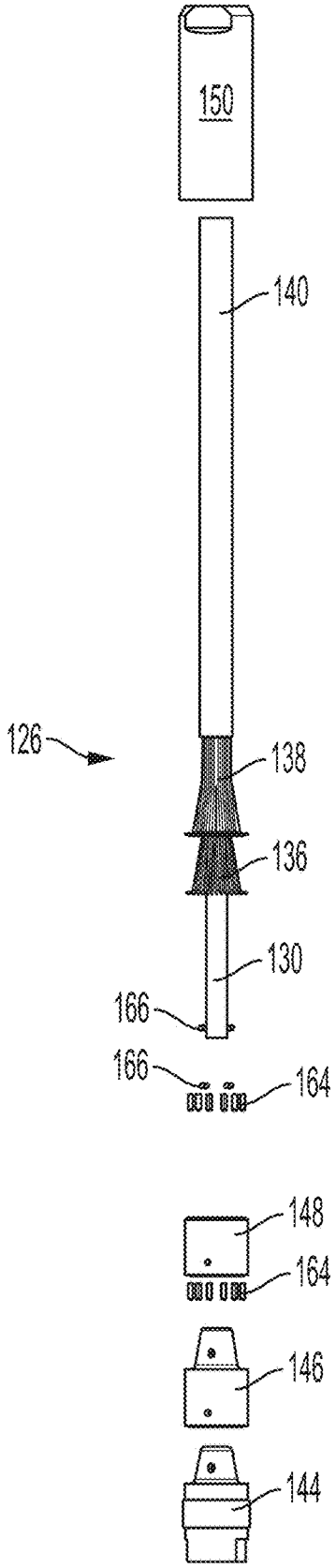

Turning to FIGS. 3A and 3B, shown therein are side and exploded views, respectively, of a portion of the armored cable 126 and the cable adapter 142. The cable adapter 142 includes a lower collet 144, an upper collet 146, a collet cap 148 and a compression cap 150. Generally, the outer layer of structural wire 138 is captured between the collet cap 148 and the upper collet 146, while the inner layer of structural wire 136 is captured between the upper collet 146 and the lower collet 144. Once installed, the compression cap 150 applies a compressive force between the collet cap 148 and the lower collet 144 to capture the inner and outer layers of structural wire 136, 138 within the cable adapter 142.

Figure 4A:
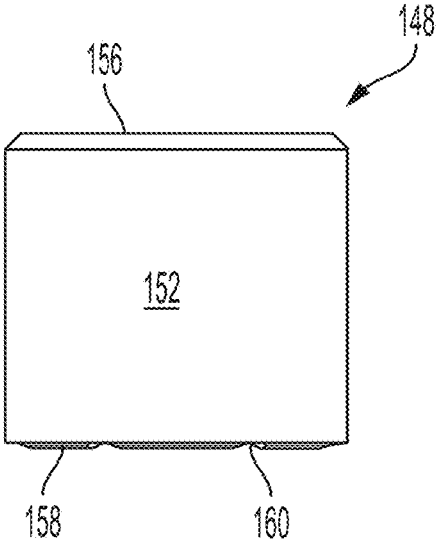
FIGS. 4A and 4B present side and cross-sectional views of the collet cap.
Figure 4B:
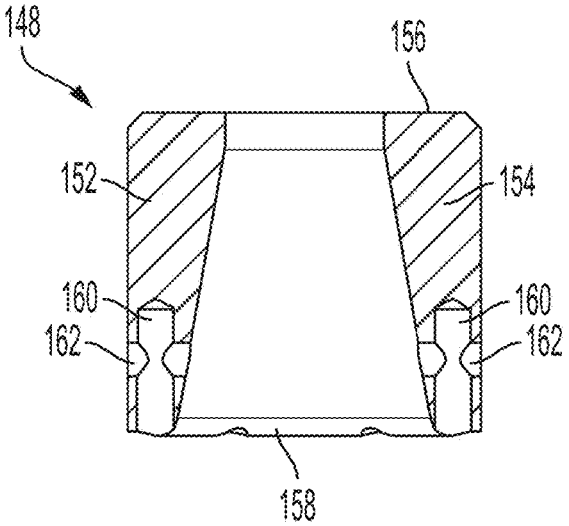

Turning to FIGS. 4A and 4B, shown therein are side and cross-sectional views, respectively, of the collet cap 148. The collet cap 148 has a generally cylindrical collet cap body 152 that includes a tapered interior channel 154, an upper face 156 and a lower contact ring 158. The collet cap 148 includes a plurality of alignment bores 160 that extend through the lower contact ring 158 of the collet cap 148. The collet cap 148 also includes a plurality of retaining pin bores 162 that extend from the outer cylindrical surface of the collet cap body 152 into the tapered interior channel 154. The tapered interior channel 154 can include grooves, channels, cross-hatching or other frictional elements to improve contact with the outer layer of structural wire 138. In some embodiments, the retaining pin bores 162 intersect the alignment bores 160. As explained in greater detail below, one or more of the alignment bores 160 is configured to receive a corresponding alignment pin 164, and one or more of the retaining pin bores 162 is configured to receive a corresponding retaining pin 166.

Figure 5A:
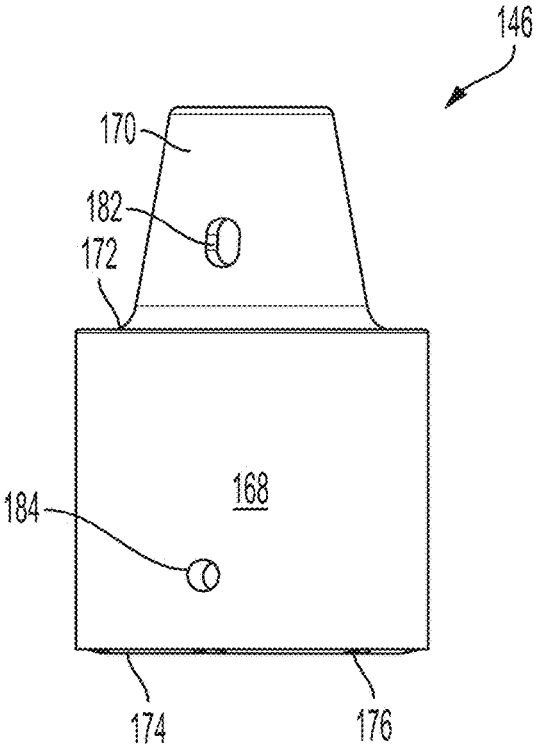
FIGS. 5A and 5B present side and cross-sectional views of the upper collet.
Figure 5B:
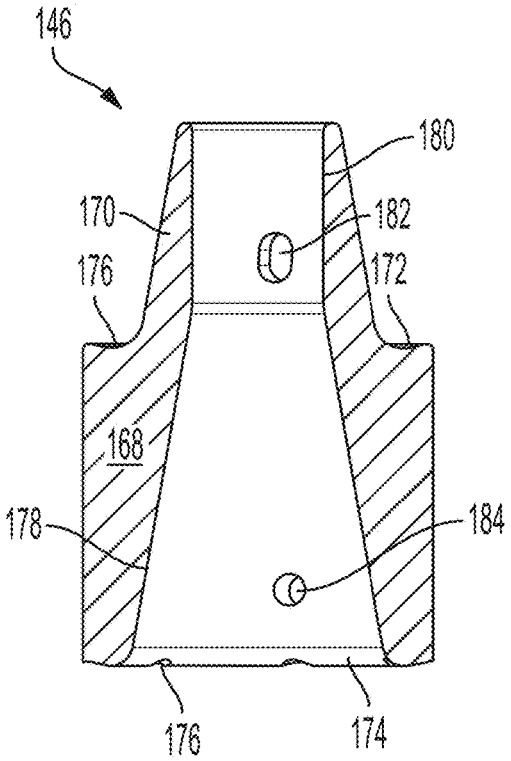

Turning to FIGS. 5A and 5B, shown therein are side and cross-sectional views, respectively, of the upper collet 146. The upper collet 146 has a cylindrical base 168 and a conical head 170 extending from the cylindrical base 168. The upper collet 146 includes an upper circular channel 172 at the junction between the conical head 170 and the cylindrical base 168. The upper collet 146 includes a lower contact ring 174 at the bottom of the cylindrical base 168. Alignment bores 176 extend into the cylindrical base 168 through the upper circular channel 172 and the lower contact ring 174. The conical head 170 can include grooves, channels, cross-hatching or other frictional elements to improve contact with the outer layer of structural wire 138.

The cylindrical base 168 includes a tapered interior channel 178 that transitions to a cylindrical channel 180 in the conical head 170. The upper collet 146 includes an oblong upper retaining pin slot 182 that extends through the conical head 170 into the cylindrical channel 180, and a lower retaining pin bore 184 that extends through the cylindrical base 168 into the tapered interior channel 178. The tapered interior channel 178 can include grooves, channels, cross-hatching or other frictional elements to improve contact with the inner layer of structural wire 136.

When the collet cap 148 is approximated with the upper collet 146, the conical head 170 of the upper collet 146 fits inside the tapered interior channel 154 of the collet cap 148. The wedge-like engagement secures the outer layer of structural wire 138 between the upper collet 146 and the collet cap 148. The retaining pin bores 162 of the collet cap 148 are aligned with the upper retaining pin slot 182 of the upper collet 146. The rotational or lateral positions of the collet cap 148 and the upper collet 146 can be fixed by registering the alignment bores 160 of the collet cap 148 with the alignment bores 176 of the upper collet 146. The alignment pins 164 extend into both the alignment bores 160 and alignment bores 176 to maintain the alignment between the upper collet 146 and the collet cap 148. In exemplary embodiments, the aggregate length of the alignment bores 160 and the alignment bores 176 is greater than the length of the corresponding alignment pin 164, which permits the upper collet 146 and the collet cap 148 to shift in a longitudinal (axial) direction while the cable adapter 142 is being assembled without losing alignment.

The collet cap 148 can be locked into position on the upper collet 146 by inserting retaining pins 166 through the retaining pin bores 162 of the collet cap 148 and into the corresponding upper retaining pin slots 182 of the upper collet 146. The oblong shape of the upper retaining pin slots 182 permits a degree of longitudinal (axial) movement between the upper collet 146 and the collet cap 148. In this way, the upper collet 146 and the collet cap 148 are configured to cooperatively capture strands of the outer layer of structural wire 138 between the conical head 170 and the tapered interior channel 154 and between the lower contact ring 158 and the upper circular channel 172.

Figure 6A:
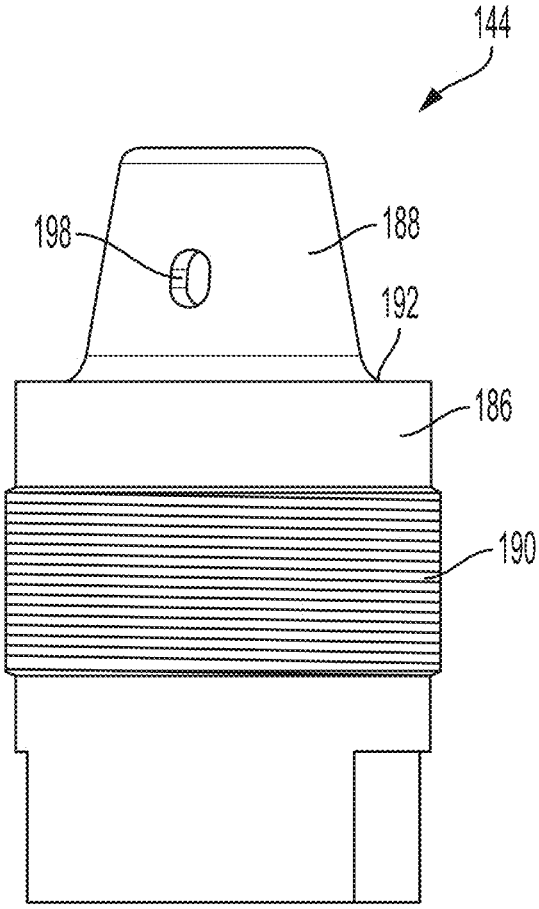
FIGS. 6A and 6B present side and cross-sectional views of the lower collet.
Figure 6B:
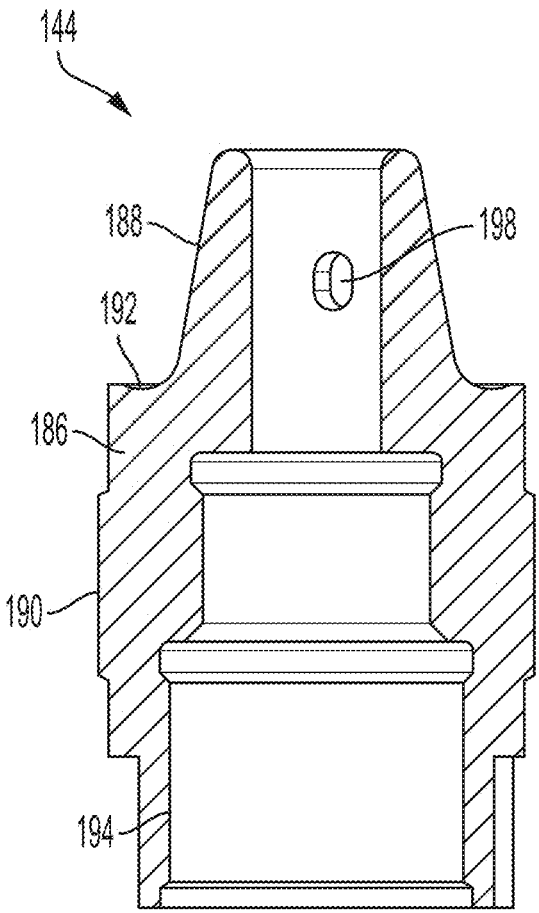
Figure 10:
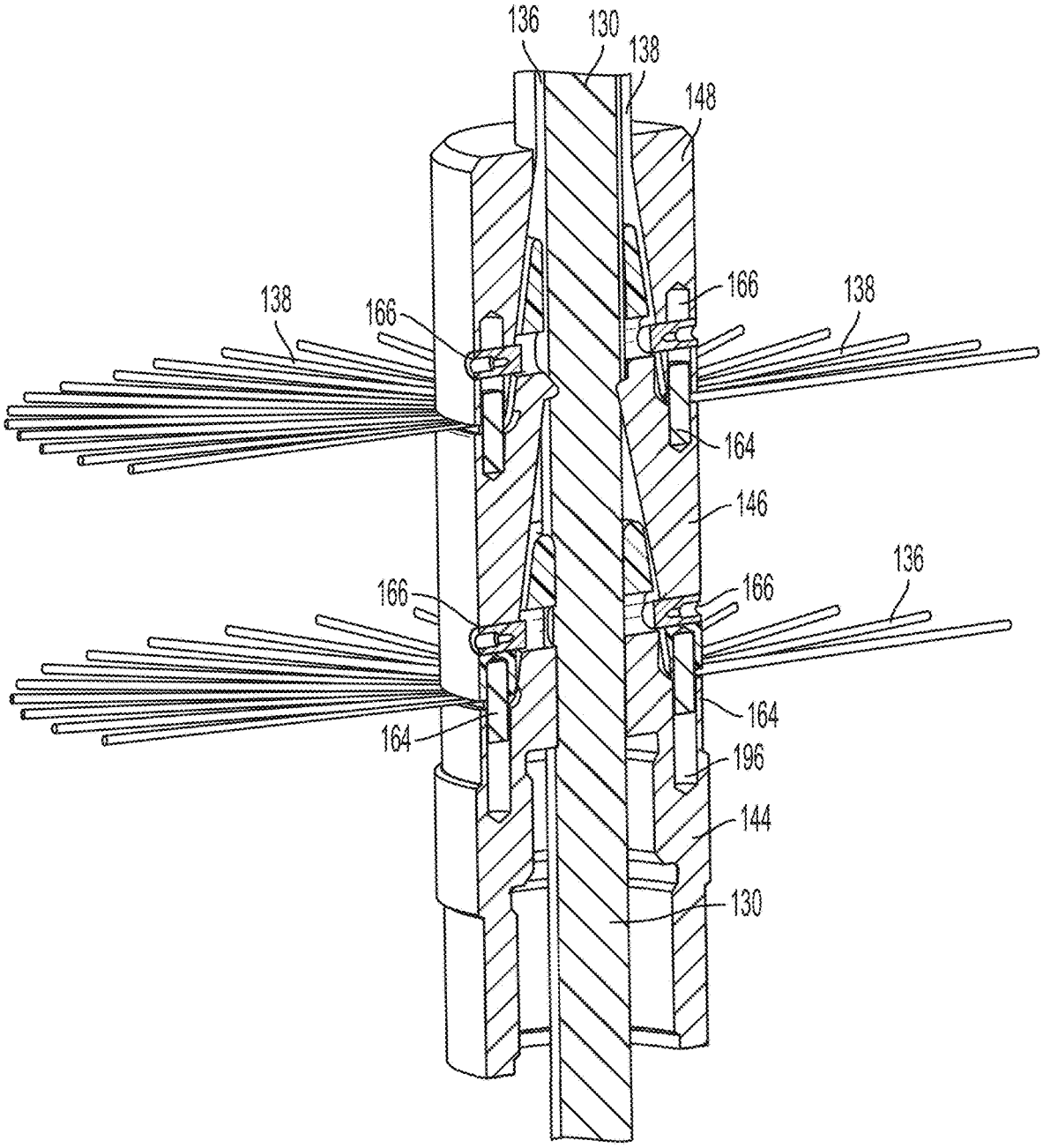
FIG. 10 presents a perspective view of the armored power cable and power cable adapter in a third step of assembly.
Figure 11A:
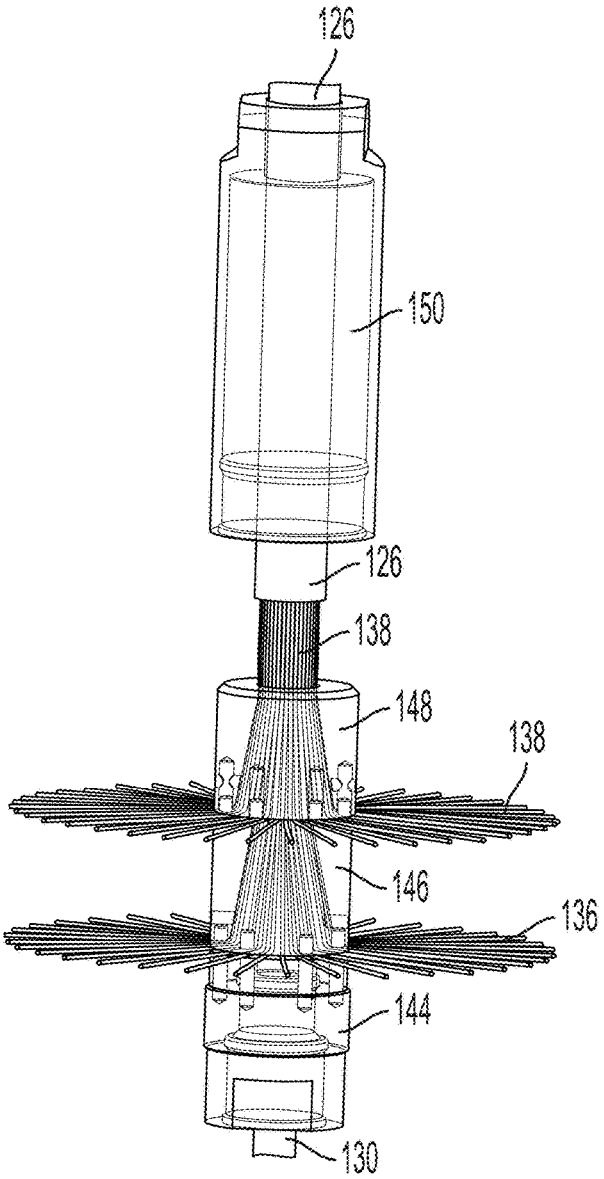
FIGS. 11A and 11B provide perspective and cross-sectional views of the armored power cable and power cable adapter in a fourth step of assembly.
Figure 11B:
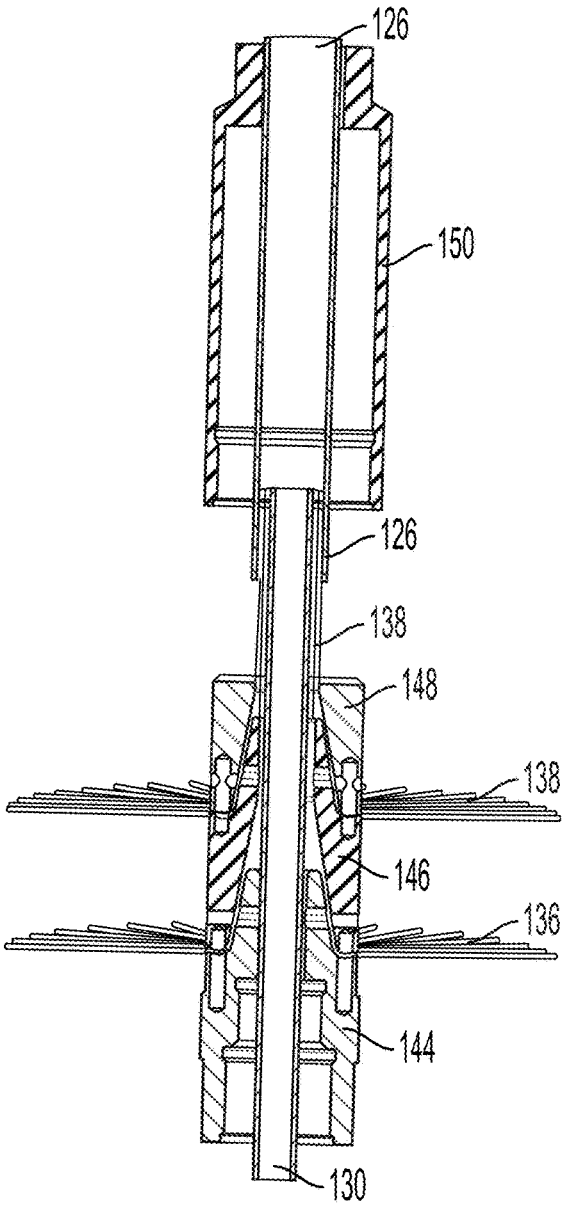

Turning to FIGS. 6A and 6B, shown therein are side and cross-sectional views, respectively, of the lower collet 144. The lower collet 144 has a cylindrical base 186 and a conical head 188 that extends from the cylindrical base 186. The cylindrical base 186 includes an exterior threaded portion 190. The lower collet 144 includes an upper circular channel 192 at the junction between the conical head 188 and the cylindrical base 186. The lower collet 144 includes a central channel 194 that extends through the lower collet 144. The central channel 194 is sized to permit the power cable 130 to pass through the lower collet 144. As best depicted in FIGS. 10 and 12B, alignment bores 196 extend into the cylindrical base 186 through the upper circular channel 192. The lower collet 144 can include additional threads or flanges to permit the attachment of the lower collet 144 to the motor 114 or other component within the pumping system 100. The conical head 188 can include grooves, channels, cross-hatching or other frictional elements to improve contact with the inner layer of structural wire 136.

The lower collet 144 includes an oblong upper retaining pin slot 198 that extends through the conical head 188 into the central channel 194. When the upper collet 146 is approximated with the lower collet 144, the conical head 188 of the lower collet 144 fits inside the tapered interior channel 178 of the upper collet 146. The wedge-like engagement between the lower collet 144 and the upper collet 146 secures the inner layer of structural wire 136. The lower retaining pin bores 184 of the upper collet 146 are aligned with the upper retaining pin slots 198 of the lower collet 144. The rotational or lateral positions of the upper and lower collet 146, 144 can be fixed by registering the alignment bores 176 of the upper collet 146 with the alignment bores 196 of the lower collet 144. The alignment pins 164 extend into both the alignment bores 196 and alignment bores 176 to maintain the alignment between the upper collet 146 and the lower collet 144. In exemplary embodiments, the aggregate length of the alignment bores 196 and the alignment bores 176 is greater than the length of the corresponding alignment pins 164, which permits the upper collet 146 and the lower collet 144 to shift in a longitudinal direction while the cable adapter 142 is being assembled.

The upper collet 146 can be locked onto the lower collet 144 by inserting retaining pins 166 through the lower retaining pin bores 184 of the upper collet 146 and the corresponding upper retaining pin slots 198 of the lower collet 144. The larger oblong shape of the upper retaining pin slots 198 permits a degree of longitudinal movement between the upper collet 146 and the lower collet 144. In this way, the upper collet 146 and the lower collet 144 are configured to cooperatively capture strands of the inner layer of structural wire 136 between the conical head 188 and the tapered interior channel 178 and between the lower contact ring 174 and the upper circular channel 192.

Figure 7A:
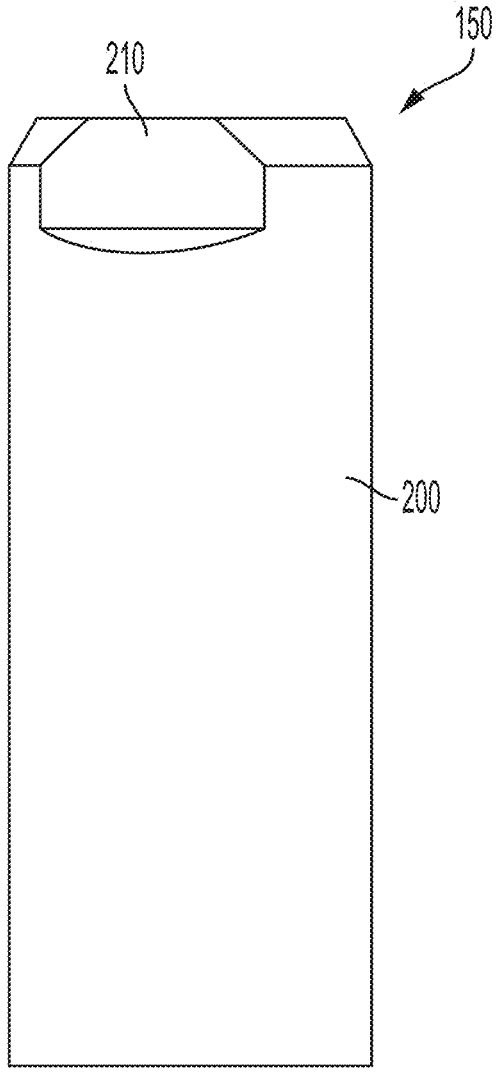
FIGS. 7A and 7B present side and cross-sectional views of the compression cap.
Figure 7B:
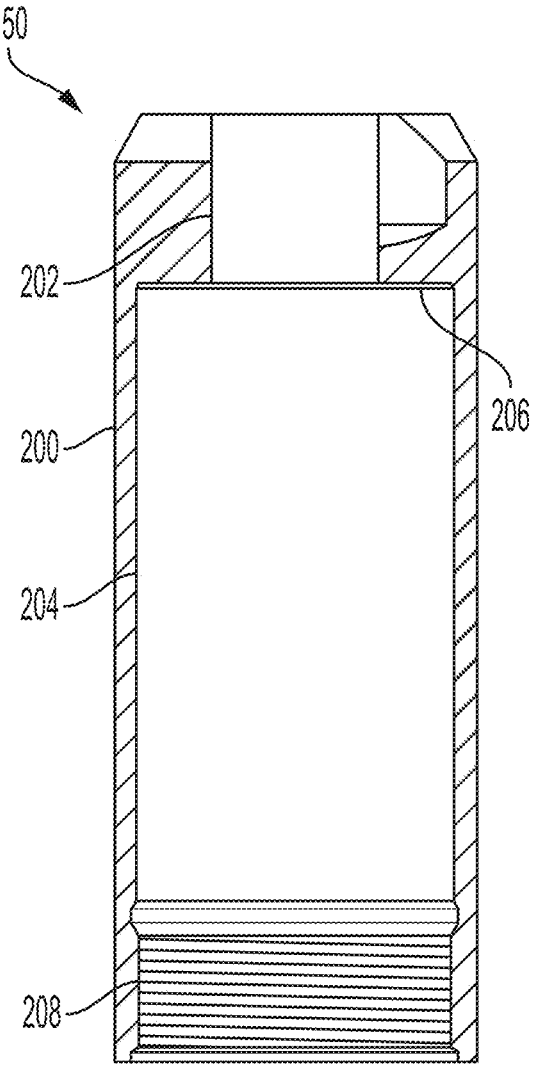

Turning to FIGS. 7A and 7B, shown therein are side and cross-sectional views, respectively, of the compression cap 150. The compression cap 150 has a cylindrical body 200 that includes an upper channel 202, an interior chamber 204, an interior abutment face 206, and an interior threaded portion 208. The upper channel 202 is sized to accept the exterior sheath 140 of the armored cable 126. The interior chamber 204 is connected to the upper channel 202 and sized to enclose the collet cap 148, the upper collet 146 and the lower collet 144.

When the lower collet 144, upper collet 146, and collet cap 148 have been assembled, the compression cap 150 is lowered onto the collet cap 148, the upper collet 146 and the lower collet 144 such that the interior abutment face 206 contacts the upper face 156 of the collet cap 148 and the interior threaded portion 208 engages the exterior threaded portion 190 of the lower collet 144. In this way, when the compression cap 150 is threaded onto the lower collet 144, it applies a compressive force between the lower collet 144 and the collet cap 148. This removes any axial play between the collet cap 148, the upper collet 146 and the lower collet 144 to securely capture the inner and outer layers of structural wire 136, 138 within the cable adapter 142. In the embodiment depicted in FIGS. 7A and 7B, the compression cap 150 includes a tool flat 210 that can be used to properly torque the compression cap 150 onto the lower collet 144 with a wrench or similar tool to apply the appropriate compression within the cable adapter 142. In some embodiments, properly torquing the compression cap 150 will crimp or cut the inner and outer layers of structural wire 136, 138 between the lower and upper collets 144, 146 and between the upper collet 146 and collet cap 148, respectively.

Figure 8:
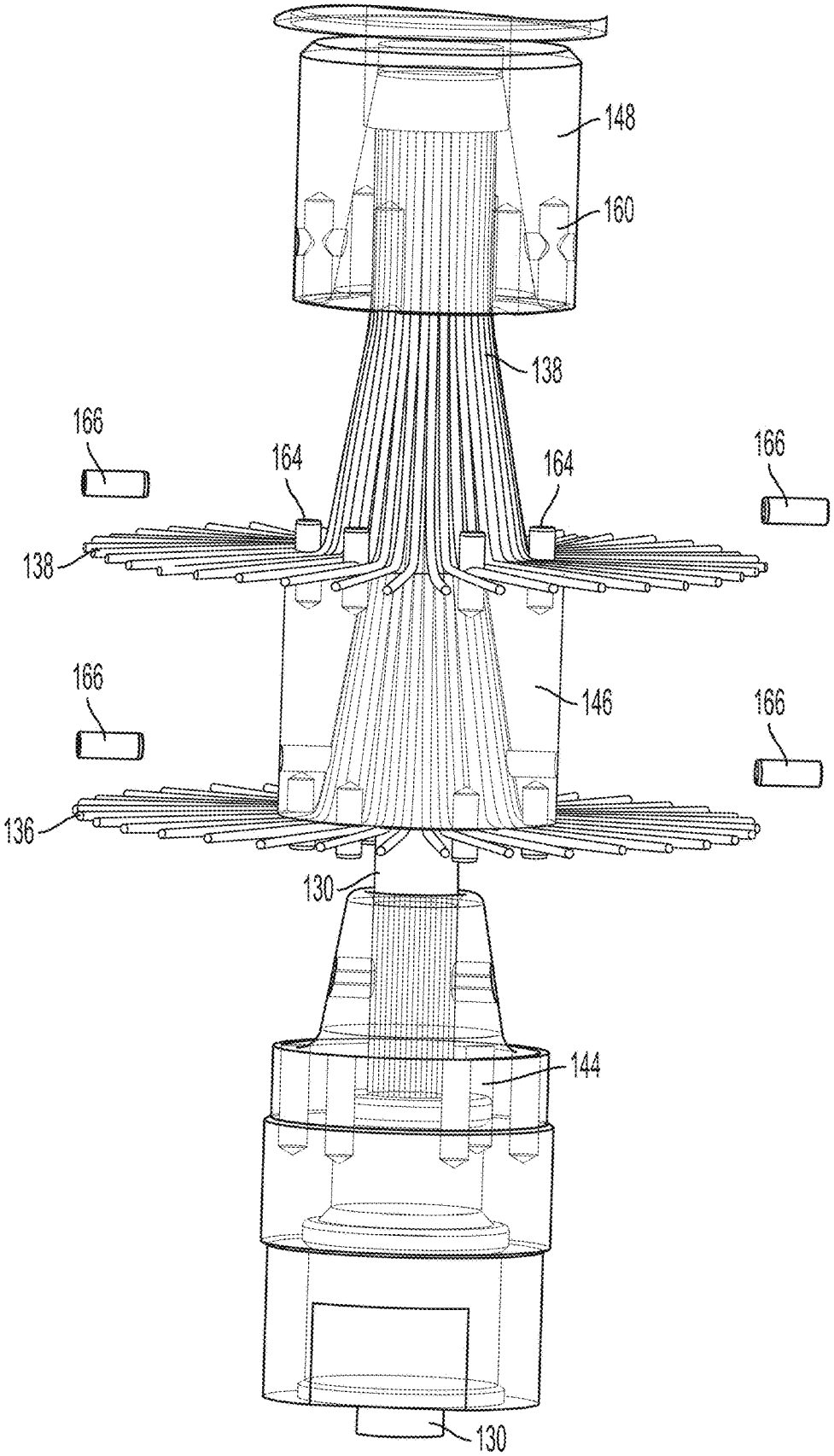
FIG. 8 presents a perspective view of the armored power cable and power cable adapter in a first step of assembly.
Figure 9:
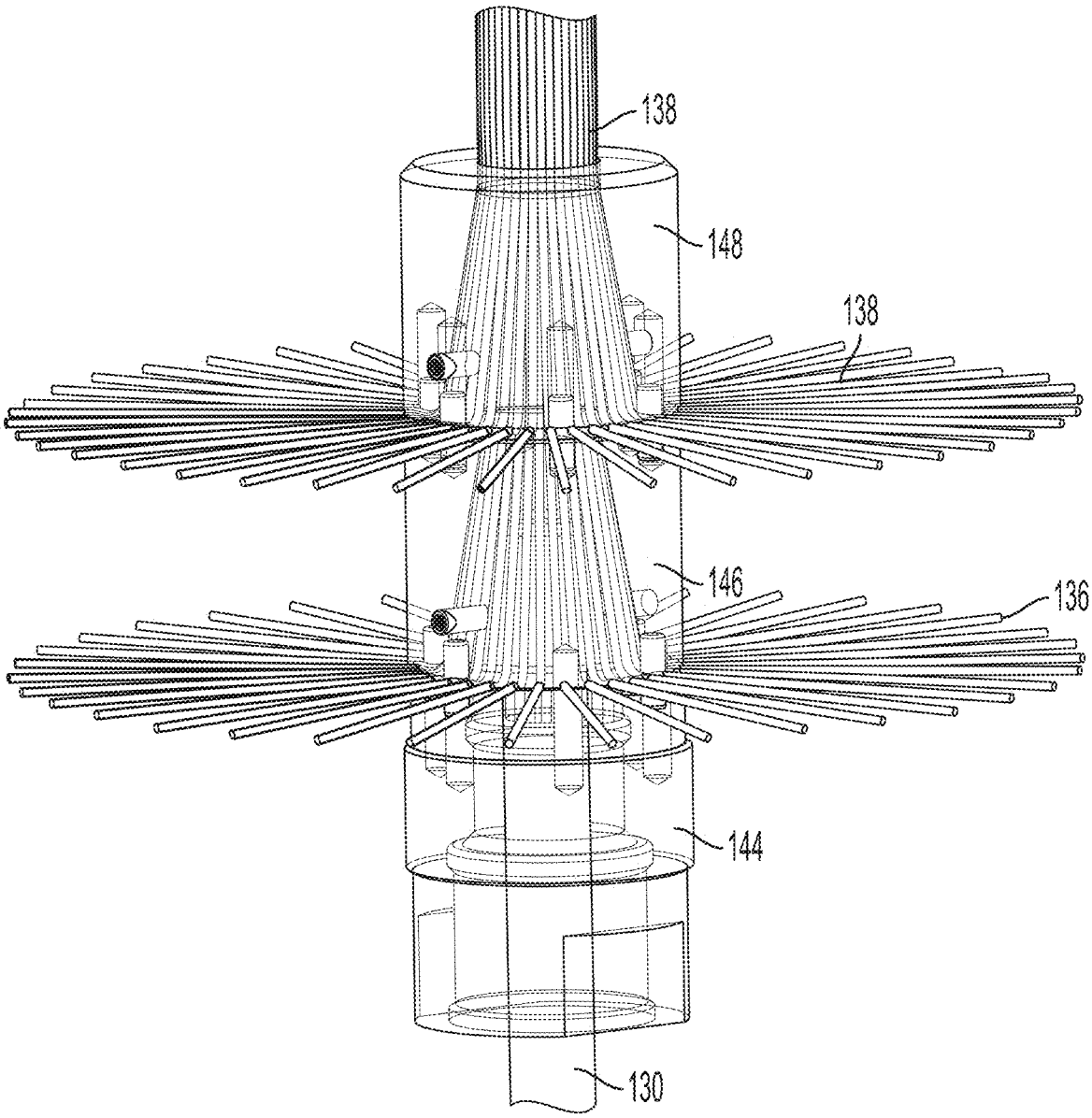
FIG. 9 presents a perspective view of the armored power cable and power cable adapter in a second step of assembly.

Turning to FIGS. 8-13, shown therein are depictions of various steps in the process for assembling the cable adapter 142 and armored cable 126. In FIG. 8, the armored cable 126 has been extended through the collet cap 148 and the strands of the outer layer of structural wire 138 have been separated from the inner layer of structural wire 136. The strands of the outer layer of structural wire 138 are separated and spread around the outside of the conical head 170 of the upper collet 146. The inner layer of structural wire 136 and the power cable 130 extend through the upper circular channel 192 of the lower collet 144 and the strands of the inner layer of structural wire 136 are separated and spread around the outside of the conical head 188 of the lower collet 144. The alignment pins 164 are inserted into the alignment bores 176 of the upper collet 146 in preparation for the connection of the collet cap 148 and the lower collet 144.

In FIGS. 9, 10, 11A and 11B, the collet cap 148, upper collet 146 and lower collet 144 have been compressed together and registered such that the alignment pins 164 extend between the alignment bores 160, 176 and 196. The retaining pins 166 have been inserted to retain the longitudinal position of the collet cap 148 on the upper collet 146, and the upper collet 146 on the lower collet 144. The strands of the outer layer of structural wire 138 are captured between the collet cap 148 and the upper collet 146, while the strands of the inner layer of structural wire 136 are captured between the upper collet 146 and the lower collet 144. The ends of the wires of the inner and outer layers of structural wire 136, 138 can be seen extending radially outward from the cable adapter 142.

Figure 12A:
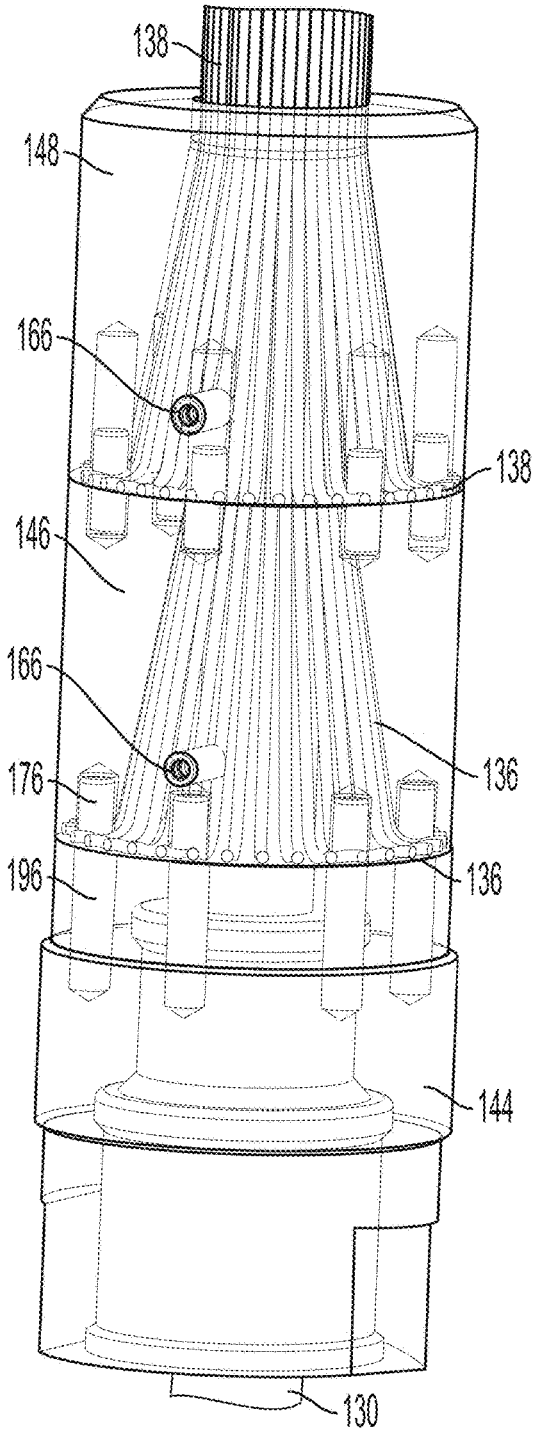
FIGS. 12A and 12B provide perspective and cross-sectional views of the armored power cable and power cable adapter in a fifth step of assembly.
Figure 12B:
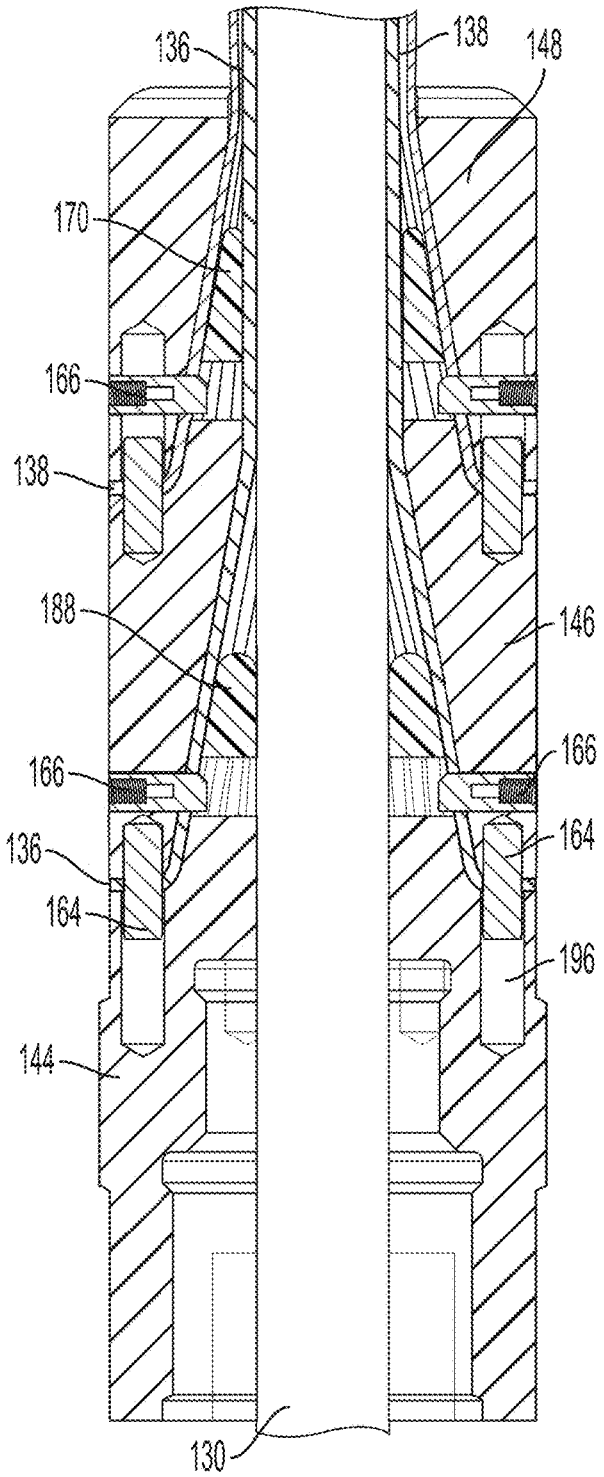

As depicted in FIGS. 12A and 12B, the exposed ends of the strands of the inner and outer layers of structural wire 136, 138 are clipped or trimmed before the compression cap 150 is installed. The ends of the strands of the inner and outer layers of structural wire 136, 138 can be clipped with wire cutters or a saw. In some embodiments, the lower contract ring 158 of the collet cap 148 and the upper circular channel 172 of the upper collet 146 are each fitted with beveled mating surfaces that together clip the ends of the strands of outer layer of structural wire 138 when collet cap 148 is compressed into to the upper collet 146. Similarly, the lower contact ring 174 of the upper collet 146 and the upper circular channel 192 of the lower collet 144 can also be fitted with mating cutting surfaces that sever the ends of the strands of the inner layer of structural wire 136 when the upper and lower collets 146, 144 are compressed together.

Figure 13A:
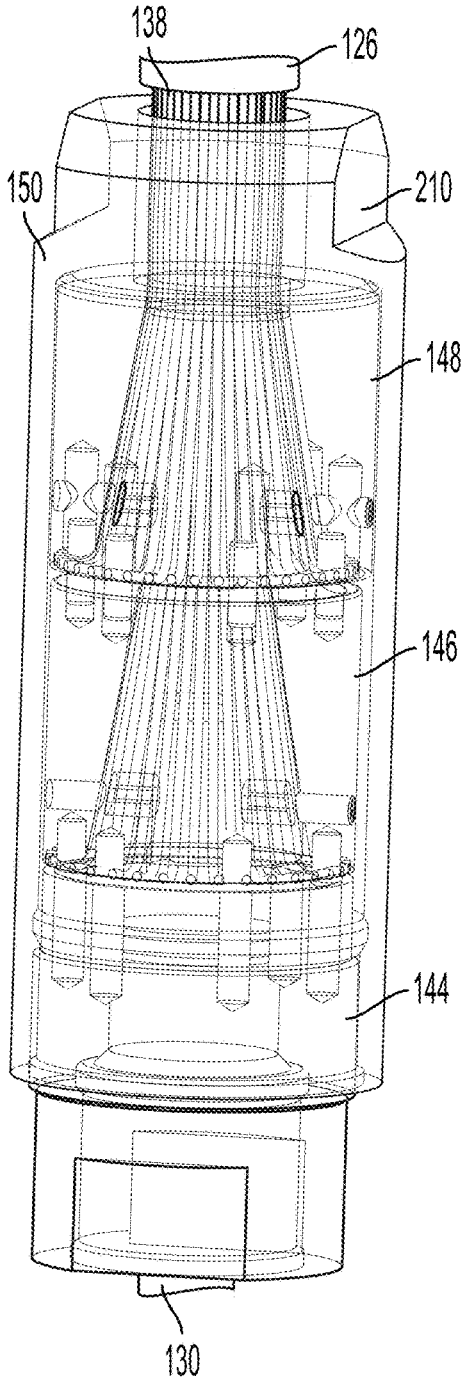
FIGS. 13A and 13B provide perspective and cross-sectional views of the armored power cable and power cable adapter in a sixth step of assembly.
Figure 13B:
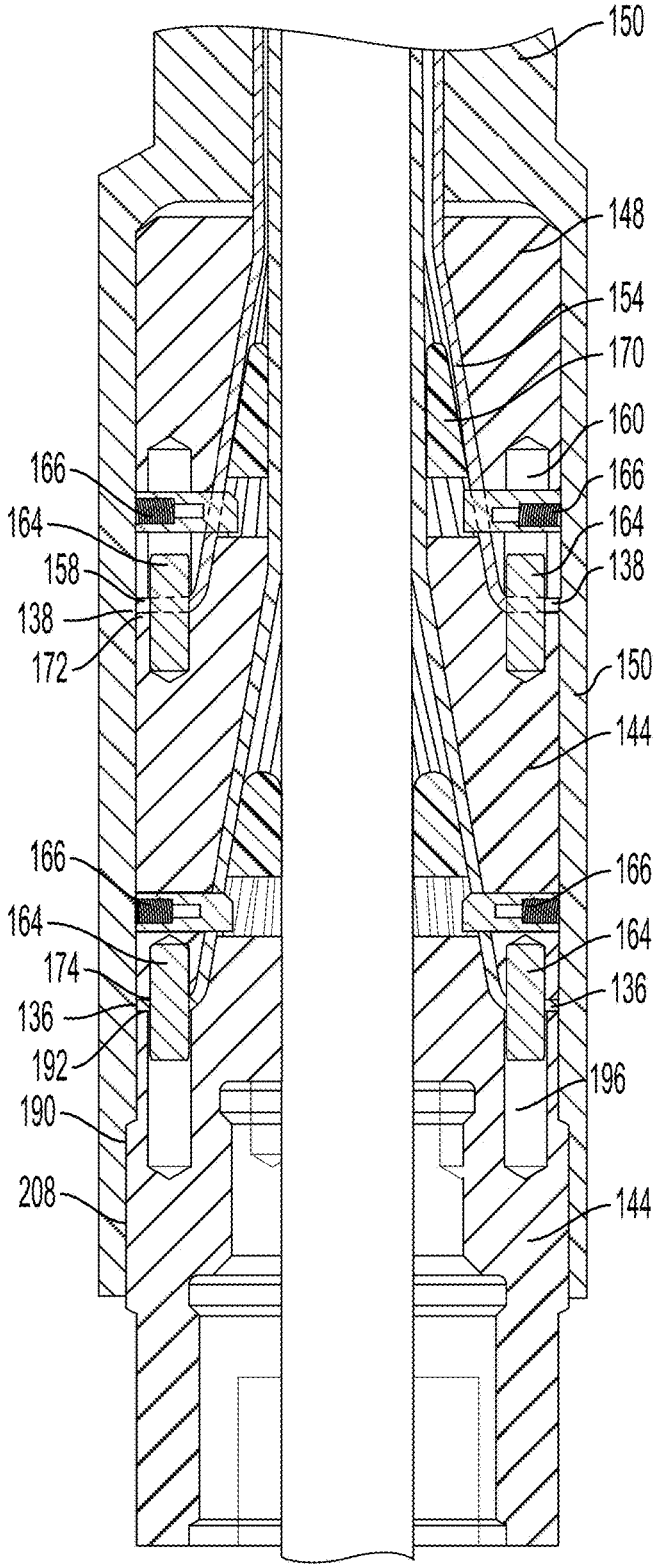

In FIGS. 13A and 13B, the compression cap 150 has been lowered onto the collet cap 148, upper collet 146 and lower collet 144. The compression cap 150 is then threaded onto the lower collet 144 and torqued to the appropriate specification to capture the compressive force exerted on the inner and outer layers of structural wire 136, 138 by the collet cap 148, upper collet 146 and lower collet 144. The cable adapter 142 is fully assembled and can be connected to the motor 114 or another component of the pumping system 100.

In some embodiments, the armored cable 126 includes a single layer of structural wire and the cable adapter 142 includes a single collet and collet cap. In other embodiments, the armored cable 126 includes more than two layers of structural wire and the cable adapter includes a corresponding number of collets for securing each layer of the structural wire.

Figure 14:
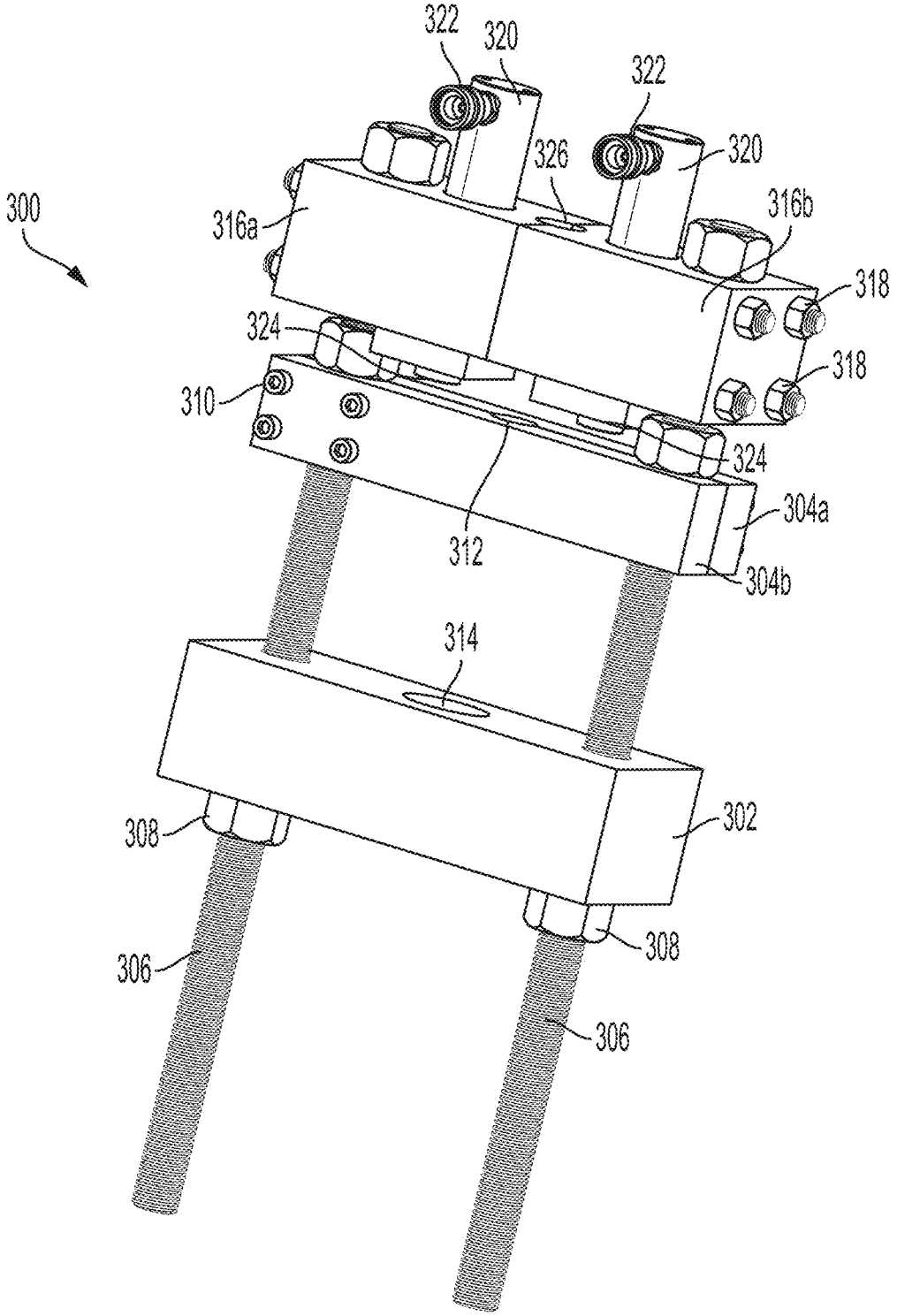
FIG. 14 is a perspective view of a press configured to assist with the assembly of the power cable adapter on the armored power cable.

Although the cable adapter 142 can be assembled using clamps, vises or other hand tools, for some applications it may be desirable to use a hydraulic assembly tool. Turning to FIG. 14, shown therein is an assembly tool 300 configured to apply a compressive force to the cable adapter 142 during assembly. The assembly tool 300 is generally configured as a manual or powered hydraulic press that can be positioned around the cable adapter 142. The assembly tool 300 includes a lower plate 302, an upper plate 304 and a pair of tie rods 306 that extend through the upper and lower plates 302, 304. In some embodiments, the tie rods 306 are threaded and adjustment nuts 308 can be used to control the distance between the upper and lower plates 302, 304.

The upper plate 304 includes two halves 304*a*, 304*b* that are connected with plate bolts 310. In the embodiment depicted in FIG. 14, each of the upper plate halves 304*a*, 304*b* extends between the two tie rods 306. This permits the upper plate 304 to be removed from the tie rods 306. The upper plate 304 includes an upper plate central aperture 312. The lower plate 302 includes a lower plate central aperture 314. The lower plate 302 can be constructed as a single piece or multiple pieces joined together with lower plate bolts (not shown).

The assembly tool 300 also includes a cylinder block 316 that is connected between the tie rods 306 and located outboard the upper plate 304. In the embodiment depicted in FIG. 16, the cylinder block 316 includes two halves 316*a*, 316*b* that are held together with cylinder block bolts 318. Each cylinder plate half 316*a*, 316*b* includes a cylinder 320. The cylinder 320 can be a hydraulic cylinder that includes a coupler 322 and ram 324. When the two cylinder plate halves 316*a*, 316*b* are connected together, the cylinder block includes a cylinder block central aperture 326 between the two cylinders 320. The cylinder block central aperture 326 is axially aligned with the upper plate central aperture 312 and the lower plate central aperture 314.

When the cylinders 320 are connected by the coupler 322 to a hydraulic pump or generator that produces a source of controllably pressurized hydraulic fluid, the rams 324 extend out of the cylinders 320 and contact the upper plate 304. To ensure that the two cylinders 320 apply substantially the same force, a splitter or manifold (not shown) can be used to supply hydraulic fluid under equalized pressure. In some embodiments, the hydraulic cylinders 320 are dual acting and can be retracted by reversing the direction of the hydraulic fluid. In other embodiments, hydraulic cylinders are single action cylinders that can be retracted by depressurizing the cylinders 320 and pressing the upper plate 304 toward the cylinder block 316. Although the assembly tool 300 has been disclosed as a hydraulically driven press, it will be appreciated that in other embodiments, the upper plate 304 of the assembly tool 300 is driven by pneumatic cylinders or threaded extensible rods that are turned by hand or motor.

Figure 15A:
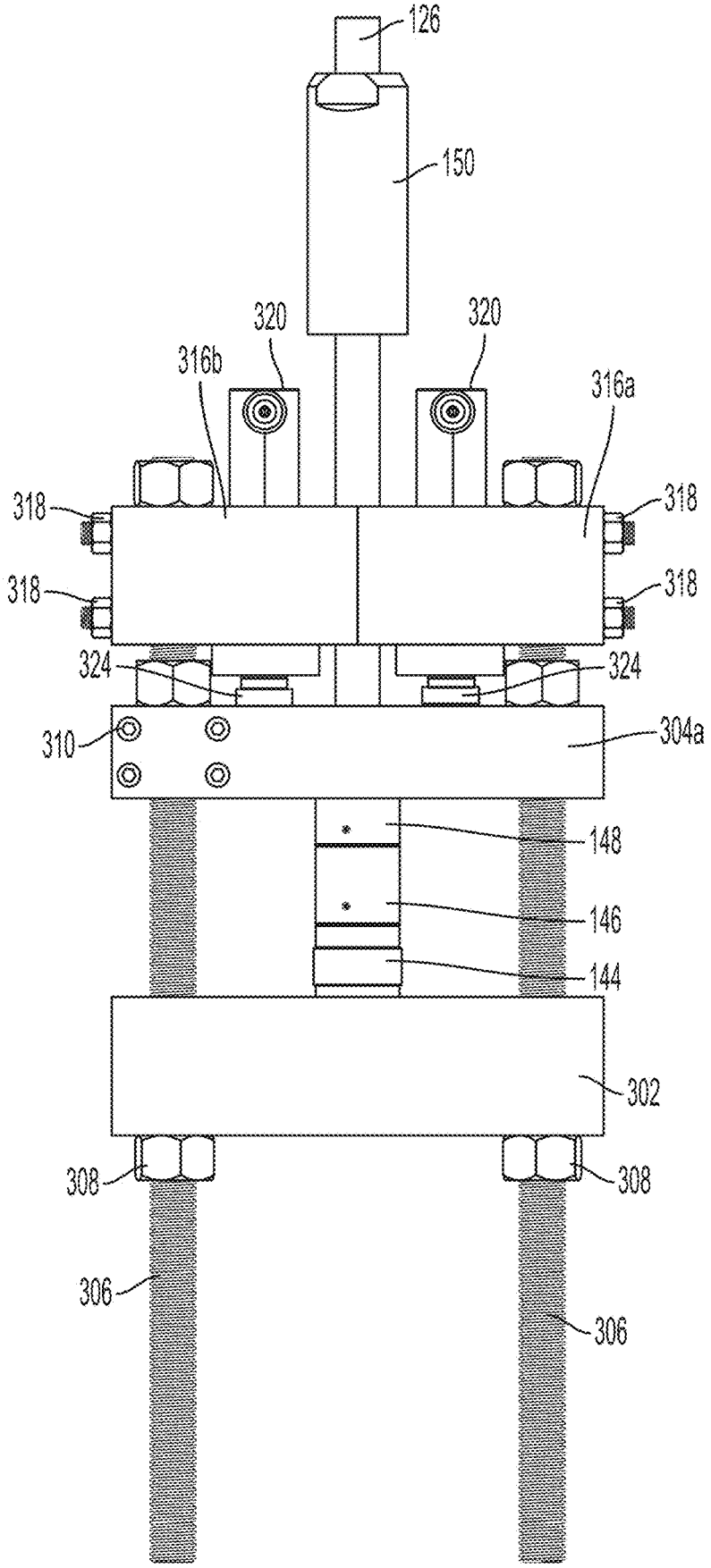
FIGS. 15A and 15B provide side and cross-sectional views of the press of FIG. 14 closing the power cable adapter around the armored power cable.
Figure 15B:
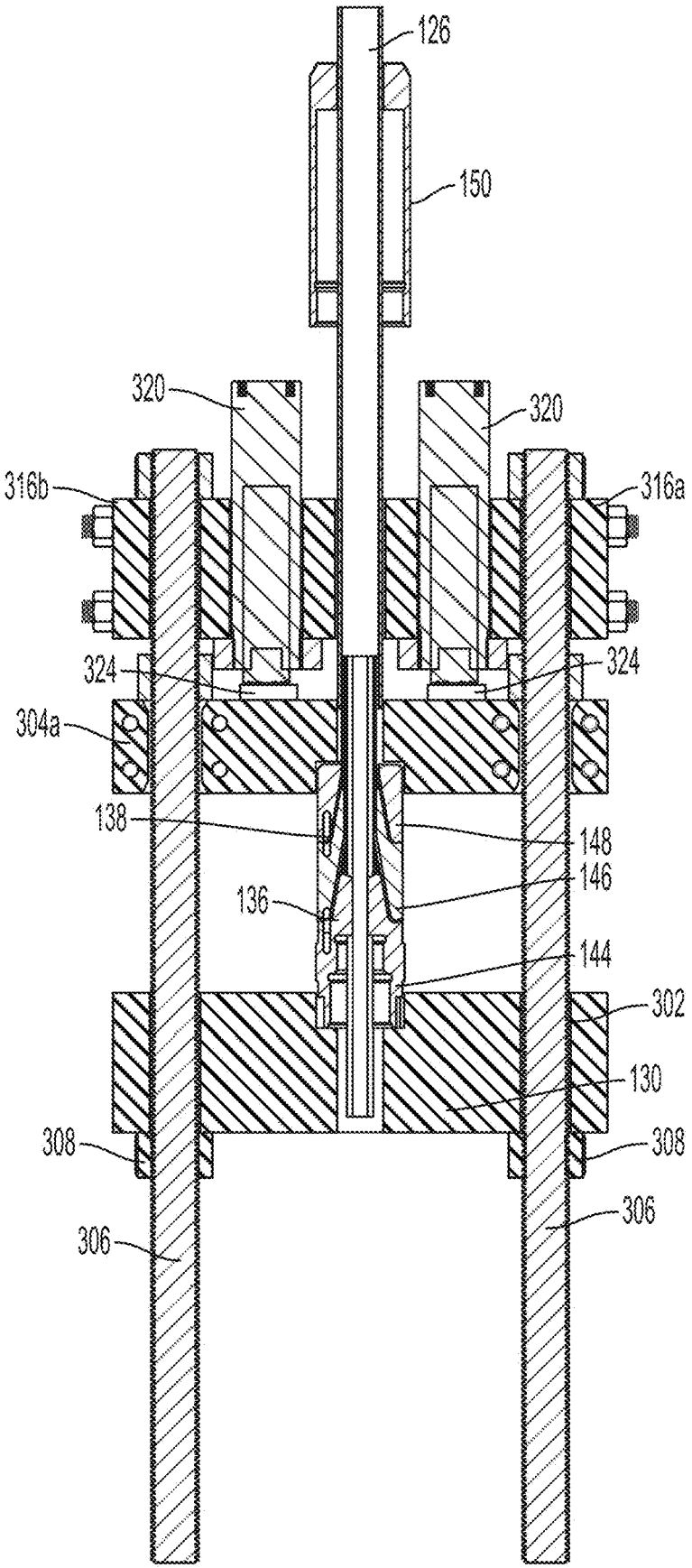

Turning to FIGS. 15A and 15B, shown therein are side and cross-sectional views, respectively, of the cable adapter 142 and armored cable 126 in the assembly tool 300. Initially, the compression cap 150 should be installed onto the armored cable 126. A portion of the exterior sheath 140 below the compression cap 150 is then removed to reveal the outer and inner layers of structural wire 138, 136. The unsheathed armored cable 126 is inserted through the collet cap 148 and the outer layer of structural wire 138 is separated and distributed around the outside of the conical head 170 of the upper collet 146, while the inner layer of structural wire 136 and power cable 130 passes through the upper collet 146. The inner layer of structural wire 136 is then separated and distributed around the outside of the conical head 188 of the lower collet 144, while the power cable extends through the central channel 194 of the lower collet 144.

The compression cap 150, collet cap 148, upper collet 146, lower collet 144 and armored cable 126 can then be placed into the assembly tool 300 by separating the upper plate 304 and cylinder block 316. The lower collet 144 is retained inside the lower plate central aperture 314, the collet cap 148 is secured in the upper plate central aperture 312, the armored power cable extends upward through the cylinder block central aperture 326, and the compression cap 150 is kept on the armored cable 126 above the assembly tool 300.

The assembly tool 300 can then be activated by supplying pressurized hydraulic fluid to the cylinders 320 to force the rams 324 and upper plate 304 downward toward the lower plate 302. The downward movement of the upper plate 304 applies a compressive force between the collet cap 148 and the lower collet 144 that compresses and captures the inner and outer layers of structural wire 136, 138 within the cable adapter 142. The excess structural wire can be trimmed before, after or during the application of compressive force by the assembly tool 300.

Once the assembly tool 300 has suitably compressed the collet cap 148, upper collet 146 and lower collet 144, the retaining pins 166 can be inserted to lock these components together under compression. The cylinders 320 can then be depressurized and retracted. As explained above, the collet cap 148, upper collet 146 and lower collet 144 may then longitudinally (axially) expand slightly due to the elongated upper retaining pin slot 198 and upper retaining pin slot 182.

The armored cable 126 and cable adapter 142 can then be removed from the assembly tool 300 by separating the cylinder block 316 and upper plate 304. The compression cap 150 can then lowered over the collet cap 148, upper collet 146 and lower collet 144. Once the interior threaded portion 208 of the compression cap 150 is engaged with the exterior threaded portion 190 of the lower collet 144, the compression cap 150 can be tightened onto the lower collet 144 to recompress the collet cap 148, upper collet 146 and lower collet 144. In exemplary embodiments, the assembly tool 300 is used to connect the cable adapter 142 to the armored cable 126 at the wellsite. In other embodiments, the assembly tool 300 is used during manufacturing to secure the cable adapter 142 to the armored cable 126.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts and steps within the principles of the present invention to the full extent indicated by the broad general meaning of the terms in which the appended claims are expressed. It will be further appreciated that unless otherwise excluded, aspects of one embodiment can be combined or incorporated into other embodiments disclosed herein. It will be appreciated by those skilled in the art that the teachings of the present invention can be applied to other systems without departing from the scope and spirit of the present invention.

It is claimed:

1. A pumping system configured to be deployed in a well, the pumping system comprising:

an armored cable, wherein the armored cable comprises:

an outer layer of structural wire;

an inner layer of structural wire; and a power cable inside the inner layer of structural wire;

an electric motor; and a cable adapter connected between the electric motor and the armored cable to transfer the weight of the electric motor to the armored cable, wherein the cable adapter comprises:

a compression cap;

a collet cap;

an upper collet, wherein the outer layer of structural wire is captured between the upper collet and the collet cap; and a lower collet that can be secured to the electric motor, wherein the inner layer of structural wire is captured between the upper collet and the lower collet.

2. The pumping system of claim 1, wherein the upper collet comprises:

a conical head and an upper circular channel; and a tapered interior channel and a lower contact ring.

3. The pumping system of claim 2, wherein the collet cap includes a tapered interior channel for engagement of the conical head of the upper collet and a lower contact ring for engagement with the upper circular channel of the upper collet.

4. The pumping system of claim 3, wherein the outer layer of structural wire is captured between the conical head of the upper collet and the tapered interior channel of the collet cap.

5. The pumping system of claim 3, wherein the outer layer of structural wire is captured between the upper circular channel of the upper collet and the lower contact ring of the collet cap.

6. The pumping system of claim 5, wherein the lower collet comprises a conical head and an upper circular channel.

7. The pumping system of claim 6, wherein the inner layer of structural wire is captured between the conical head of the lower collet and the tapered interior channel of the upper collet.

8. The pumping system of claim 6, wherein the inner layer of structural wire is captured between the lower contact ring of the upper collet and the upper circular channel of the lower collet.

9. The pumping system of claim 1, wherein the compression cap is connected to the lower collet to apply a compressive force between the lower collet and the collet cap.

10. The pumping system of claim 9, wherein the lower collet further comprises an exterior threaded portion and the compression cap further comprises an interior threaded portion, and wherein the compression cap is connected to in threaded engagement with the lower collet to apply a compressive force between the lower collet and the collet cap.

11. The pumping system of claim 9, wherein the lower collet includes a central channel and the power cable extends through the central channel.

12. A method for deploying a pumping system into a well, wherein the pumping system comprises a pump connected to an electric motor, the method comprising the steps of:

providing a length of armored cable that comprises an outer layer of structural wire, an inner layer of structural wire, and a power cable inside the inner layer of structural wire;

providing a cable adapter that comprises a collet cap, a lower collet, an upper collet between the collet cap and the lower collet, and a compression cap;

extending the armored cable through the compression cap;

routing the power cable to the electric motor through the lower collet;

securing the outer layer of structural wire between the collet cap and the upper collet;

securing the inner layer of structural wire between the upper collet and the lower collet;

connecting the compression cap to the lower collet to apply a compressive force between the lower collet and the collet cap to capture the outer layer of structural wire and inner layer of structural wire within the cable adapter;

lowering the pump and motor into the well while transferring the weight of the pump and motor to the armored cable through the cable adapter.

13. The method of claim 12, wherein the step of securing the outer layer of structural wire between the collet cap and the upper collet comprises:

spreading the outer layer of structural wire around a conical head and upper circular channel of the upper collet; and approximating the upper collet with the collet cap such that the outer layer of structural wire is captured between the conical head of the upper collet and a tapered interior channel in the collet cap and between the upper circular channel of the upper collet and a lower contact ring of the collet cap.

14. The method of claim 12, wherein the step of securing the inner layer of structural wire between the upper collet and the lower collet comprises:

spreading the inner layer of structural wire around a conical head and upper circular channel of the lower collet; and approximating the lower collet with the upper collet such that the inner layer of structural wire is captured between the conical head of the lower collet and a tapered interior channel in the upper collet and between the upper circular channel of the lower collet and a lower contact ring of the upper collet.

15. The method of claim 12, further comprising the step of inserting a plurality of retaining pins between the collet cap and the upper collet before the step of connecting the compression cap to the lower collet to apply a compressive force between the lower collet and the collet cap to capture the outer layer of structural wire and inner layer of structural wire within the cable adapter.

16. The method of claim 12, further comprising the step of inserting a plurality of retaining pins between the upper collet and the lower collet before the step of connecting the compression cap to the lower collet to apply a compressive force between the lower collet and the collet cap to capture the outer layer of structural wire and inner layer of structural wire within the cable adapter.

17. The method of claim 12, further comprising the step of trimming excess length from the outer layer of structural wire and inner layer of structural wire before the step of connecting the compression cap to the lower collet to apply a compressive force between the lower collet and the collet cap to capture the outer layer of structural wire and inner layer of structural wire within the cable adapter.

* * * * *